US005550097A

United States Patent [19]

Shibasaki et al.

[11] Patent Number: 5,550,097

[45] Date of Patent: Aug. 27, 1996

[54] COLOR RECORDING METHOD AND DEVICE

[75] Inventors: Souhei Shibasaki; Yukio Sawano; Hiroto Nagashima, all of Tokyo, Japan

[73] Assignee: Fuji Photo Film Co., Ltd., Kanagawa, Japan

[21] Appl. No.: 452,716

[22] Filed: May 30, 1995

[30] Foreign Application Priority Data

May 31, 1994 [JP] Japan ..... 6-119106

[51] Int. Cl.[6] ..... B41M 5/128

[52] U.S. Cl. ..... 503/201; 503/204; 503/205; 503/206

[58] Field of Search ..... 427/150–152; 503/201, 204–206

[56] References Cited

U.S. PATENT DOCUMENTS 3,890,156 6/1975 Matsukawa et al. ..... 106/19 A

*Primary Examiner*—Bruce H. Hess

*Attorney, Agent, or Firm*—Burns, Doane, Swecker and Mathis, L.L.P.

[57] ABSTRACT

A color recording method and device which is capable of color recording images on large-sized paper in which a first color is developed in direct heat sensitive paper by directly supplying heat energy of thermal heads to the direct heat sensitive paper. Furthermore, in order to transfer a color ink to the direct heat sensitive paper to thereby obtain a second color, the heat energy of the thermal heads is supplied to a plurality of ink ribbons which are coated with both a desensitizing material for controlling the coloring reaction of the direct heat sensitive paper and the desired colored inks.

7 Claims, 7 Drawing Sheets

⊘ LEUCO DYE

⊙ COLOR DEVELOPER

○ DECOLORED HEAT SENSITIVE RECORDING LAYER 101
103
105
107
HEAT SENSITIVE RECORDING LAYER
115
113
111
121
LEUCO DYE
COLOR DEVELOPER
DECOLORED HEAT SENSITIVE RECORDING LAYER

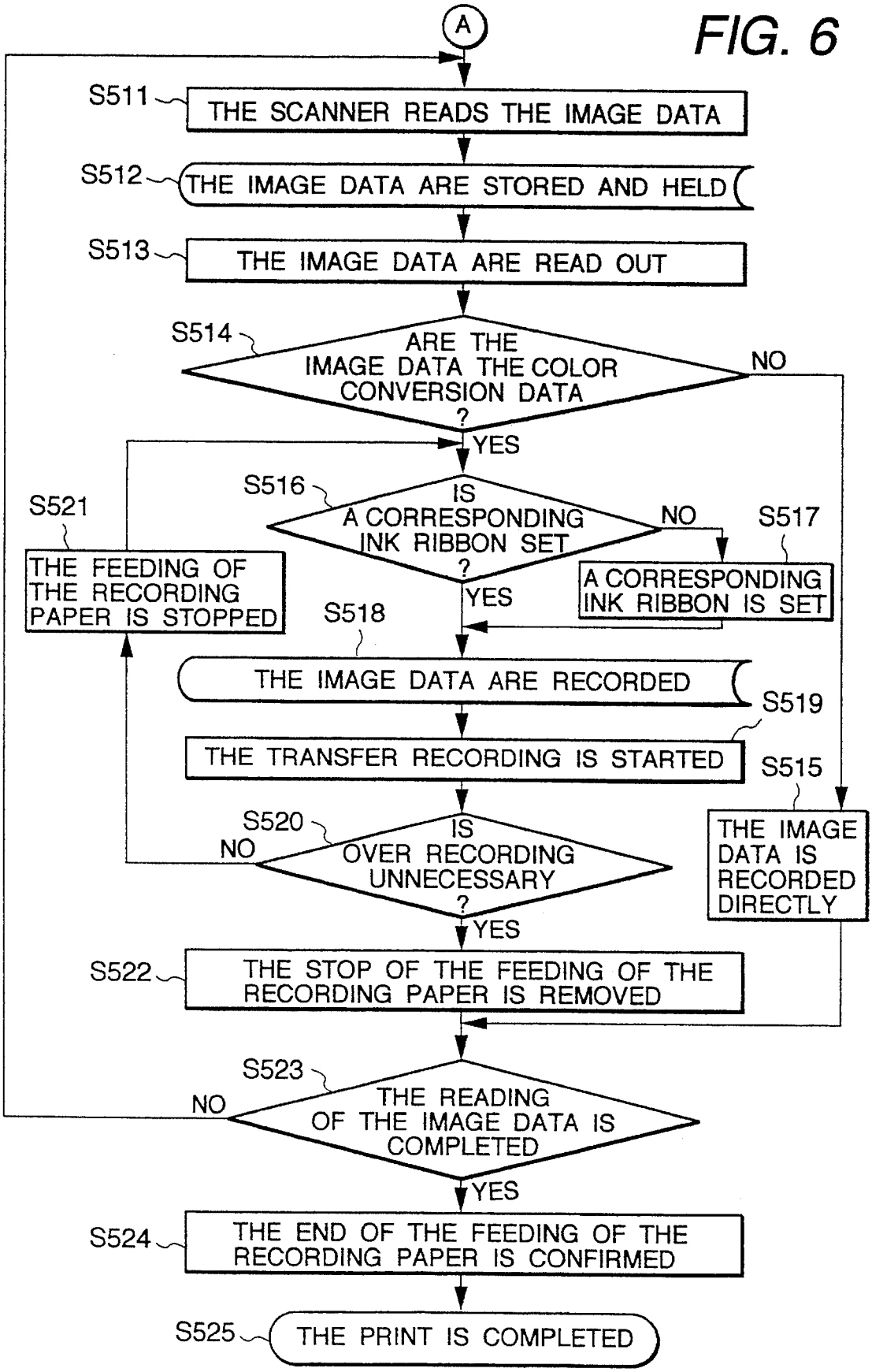
FIG. 6
A
S511
THE SCANNER READS THE IMAGE DATA
S512
THE IMAGE DATA ARE STORED AND HELD
S513
THE IMAGE DATA ARE READ OUT
S514
ARE THE IMAGE DATA THE COLOR CONVERSION DATA ?
NO
YES
S516
IS A CORRESPONDING INK RIBBON SET ?
NO
S517
A CORRESPONDING INK RIBBON IS SET
YES
S521
THE FEEDING OF THE RECORDING PAPER IS STOPPED
S518
THE IMAGE DATA ARE RECORDED
S519
THE TRANSFER RECORDING IS STARTED
S515
THE IMAGE DATA IS RECORDED DIRECTLY
S520
IS OVER RECORDING UNNECESSARY ?
NO
YES
S522
THE STOP OF THE FEEDING OF THE RECORDING PAPER IS REMOVED
S523
THE READING OF THE IMAGE DATA IS COMPLETED
NO
YES
S524
THE END OF THE FEEDING OF THE RECORDING PAPER IS CONFIRMED
S525
THE PRINT IS COMPLETED

COLOR RECORDING METHOD AND DEVICE

BACKGROUND OF THE INVENTION

The present invention relates to color recording and, in particular, to both a color recording method and a device which are capable of recording images in multiple, e.g., 2 to 5, colors on large-sized paper.

As is known well in the art, ink jet systems, electronic copying systems, thermal sublimation type transfer systems, thermal fusion type transfer systems and the like can be employed in color recording.

Moreover, because the mechanisms associated with thermal sublimation type transfer systems and thermal fusion type transfer systems are relatively simple, a compact recording device can be provided and the cost of the device can be reduced. Also, the use of ribbons respectively coated with different color inks, e.g., a yellow ink, a magenta ink and a cyan ink, allows color recording to be readily achieved.

As mentioned above, although a variety of systems are available for obtaining color recording, when the size and cost of the device are taken into consideration, choices which would be acceptable to ordinary users become more limited.

One example of a system which can satisfy both the size and cost requirements is the thermal transfer system. However, in such thermal transfer systems, the ribbons are expensive and can be quickly consumed, thus, the operating cost of such a system can be quite high. Also, because thermal transfer devices are typically arranged so as to provide "full-color" recording, the device inevitably becomes expensive.

From the viewpoint of the ordinary users, it is not always necessary that the recording device be adapted to the full-color recording but, in most cases, it is adequate that the recording device be capable of recording in multiple colors in the range of 2 to 5 colors.

Further, in recent years, the need has also arisen to record on paper having a larger size including paper of an A1 size or greater, e.g., poster and the like.

However, conventional recording systems can not record multiple colors on large-sized paper at costs acceptable to ordinary users.

SUMMARY OF THE INVENTION

Among other things, the present invention aims at eliminating the drawbacks found in the above-mentioned conventional recording methods. Accordingly, it is an object of the invention to provide a color recording method and device which are capable of relatively simple, cost effective, color recording on large-sized paper.

In attaining the foregoing, the present invention relates to a color recording method which comprises the steps of developing a color in direct heat sensitive paper which contains a leuco dye and a color developer to thereby obtain a first color, and transferring an ink and desensitizing material, which desensitizing material controls the coloring reaction of the direct heat sensitive paper, and thus provides a second color corresponding to the color ink.

Also, there is provided a color recording method in which the above-mentioned first color is developed in the major area of the direct heat sensitive paper, while the second color is transferred to the minor area of the direct heat sensitive paper.

In another aspect, the present invention relates a color recording device which supplies the heat energy of the heads directly to the direct heat sensitive paper in order to develop a first color in the direct heat sensitive paper, and, in order to transfer a color ink to the direct heat sensitive paper and thereby produce a second color, also supplies the heat energy of the heads to a plurality of ink ribbons. These ink ribbons are coated with both a desensitizing material for controlling the coloring reaction of the direct heat sensitive paper and inks having a desired color.

Another aspect of the invention relates to a color recording device which comprises a first recording part for supplying the heat energy of the heads directly to the direct heat sensitive paper to thereby develop the first color, and a second recording part for transferring the color ink to the direct heat sensitive paper to thereby transfer the second color.

According to still another aspect of the invention, a color recording device in which the plurality of ink ribbons are each movable in the feeding direction of the direct heat sensitive paper, the plurality of ink ribbons are arranged in a plurality of lines independent of one another, and heads for scanning the direct heat sensitive paper line by line are disposed opposite to the direct heat sensitive paper, is provided. In developing the first color in the direct heat sensitive paper, the heat energy of the heads is supplied directly to the direct heat sensitive paper, and, in order to obtain the second color from the plurality of ink ribbons, a required ribbon is set opposed to the heads and the heat energy of the heads is supplied to the ink ribbon to thereby transfer ink from the ribbon to the direct heat sensitive paper.

Also, a plurality of mutually independently arranged ink ribbons can be employed to provide for the desired colors, which ribbons are movable in the feeding direction of the direct heat sensitive paper, thus, heat energy can be supplied to both the direct heat sensitive paper and the ink ribbon by, e.g., a plurality of thermal heads which are arranged in a single line.

As is apparent, the recording method and device of the present invention can provide "first" and "second" colors, that is, the first color can be obtained by developing a color in the direct heat sensitive paper, while the second color can be obtained by transferring a color ink. In this regard, both the ink and the desensitizing material which controls the reaction of a leuco dye and a color developer contained in the heat sensitive layer of the direct heat sensitive paper, are transferred to the direct heat sensitive paper. Because the coloring reaction at that portion of the direct heat sensitive paper to which the desensitizing material is transferred can be prevented, the first color is not developed, and the second color is therefore, not dull, but instead, unexpectedly vivid. By transferring various color inks to the direct heat sensitive paper, the second (as well as third, fourth, fifth and so on) colors can be provided.

The first color is typically formed in the major area of the direct heat sensitive paper and the second color is formed in the minor area thereof, so that a multi-color recording can be easily provided.

BRIEF DESCRIPTION OF THE DRAWINGS

FIG. 6 is a flow chart of processing which can be performed by the device shown in FIGS. 2 and 3;

DETAILED DESCRIPTION OF THE PREFERRED EMBODIMENTS

A description will be provided for certain embodiments of the color recording method and device according to the invention.

Figures 1A, 1B, 1C:
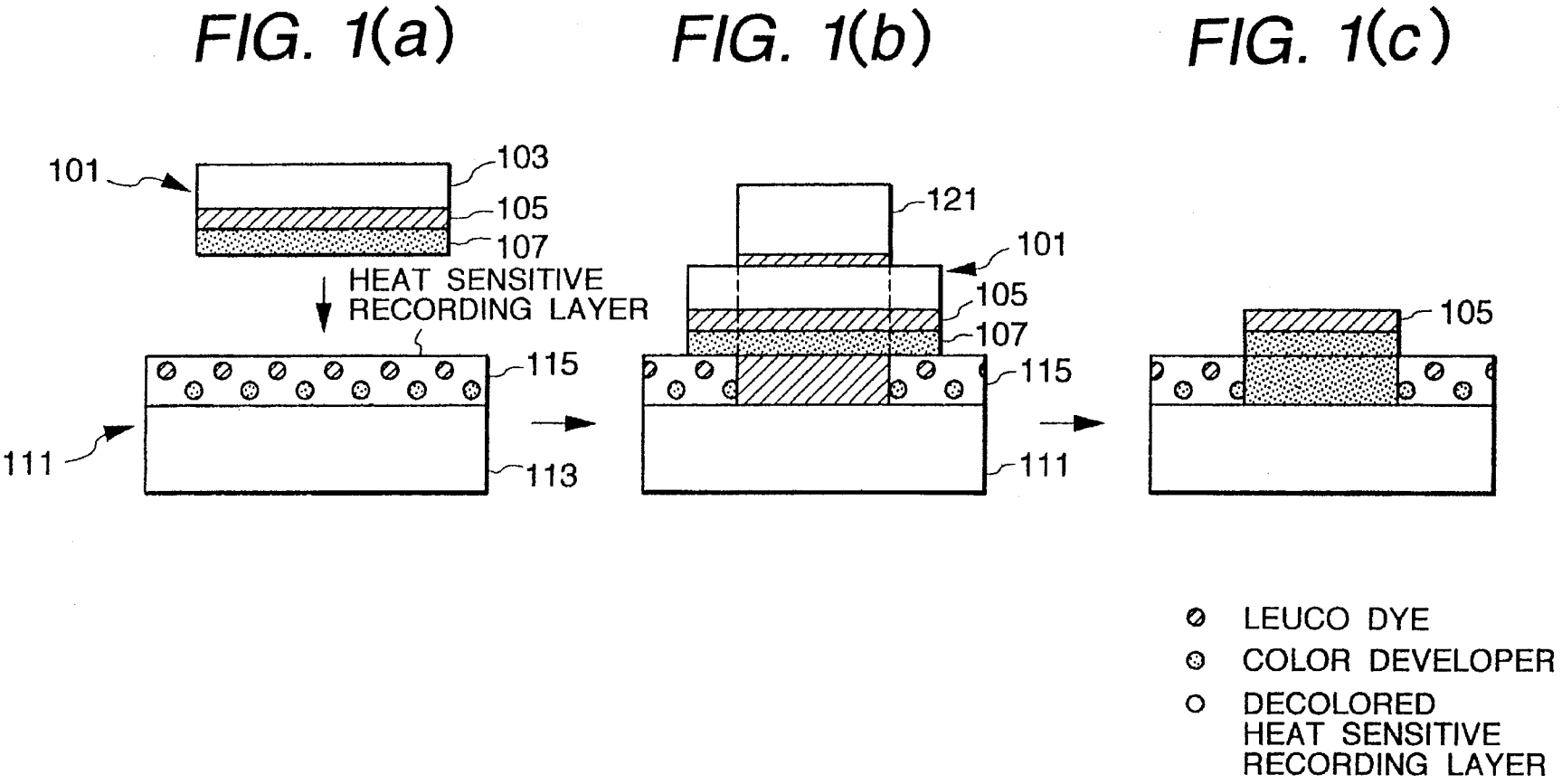
FIGS. 1(*a*) to 1(*c*) are process charts of color recording according to the invention.

FIG. 1 shows a recording process according to the invention.

As shown in FIG. 1(*a*), an ink ribbon 101 includes a base film 103 as well as an ink layer 105 and a control layer 107 both of which are coated in this order on the base film 103.

The ink layer 105 is a primary color ink layer, such as a red ink layer, a blue ink layer and the like, or combinations thereof. For example, if red and blue are allocated to the ink layer and the ink ribbons having such ink layers respectively are sequentially arranged in parallel to each other, then there can be produced a two-color, or red-and-blue ink ribbon.

The inks which can be employed within the present invention can include any ink well recognized in the art suitable for use in thermal transfer. Preferred inks are described in PRINTER DESIGN of TRICEPS CO., LTD.

The amount/thickness of this ink layer is typically is the same as that associated with conventional ink ribbons.

The control layer 107 is a layer of desensitizing material which controls the coloring reaction of a leuco dye and a color developer to be described later.

The desensitizing material can be any compound which controls the reaction of a leuco dye and a color developer contained in the heat sensitive transfer layer of the direct heat sensitive paper. Suitable examples of the desensitizing materials, include: esters including trioctyl phosphate, triphenyl phosphate, tricresyl phosphate, dioctyl adipate, dibutyl sebacate, dioctyl phthalate, dicyclohexyl phthalate, tributyl trimellitate, sorbitan fatty acid esters, polyoxyalkylene fatty acid esters, and the like; alcohols including as oleoyl alcohol, tridecyl alcohol, benzyl alcohol, and the like; ketones, including acetophenone, methylcyclohexanone, phorone, and the like; ethers including polyalkylene glycols, polyoxyalkylenealkylamines, polyoxyalkylene oleoyl ethers, polyoxyalkylene alkyl ethers, polyoxyalkylene alkenyl ethers, polyoxyalkylene alkylphenol ethers, and the like; and, organic bases including monoalkylamines, dialkylamines, trialkylamines, triphenylguanidine, dicyclohexylguanidine, 2-benzylimidazole, 2-phenol-4-methylimidazole, 2-undecylimidazoline, 2,4,5-trifuryl-2-imidazoline, N,N'-dibenzylpiperazine, and the like.

Moreover, these desensitizing materials can be used individually or in combination. The desensitizing material are present in an amount such that, upon transfer, they can prevent any substantial developing reaction between the leuco dye and the developing agent. In this regard, they are at least present in an amount of 10 wt %, preferably 30–75 wt %, to the whole transferring layers.

Direct heat sensitive paper 111 includes a base 113 coated with a heat sensitive recording layer 115 containing therein a leuco dye and a color developer.

Such direct heat sensitive papers are recognized in the art as disclosed in PRINTER DESIGN of TRICEPS CO., LTD.

Both the leuco dyes and the color developers are also recognized within the art and as such need not be described in detail here. These components are typically employed in amounts recognized in the art as described in PRINTER DESIGN of TRICEPS CO., LTD.

As shown in FIG. 1(*b*), if the heat energy of a thermal head 121 is applied to the ink ribbon 101, then both the control layer 107 and ink layer 105 of the ink ribbon 101 are transferred to the heat sensitive layer 115 of the direct heat sensitive paper 111. Due to the transfer of the ink layer 105, the heat sensitive recording layer 115 is going to develop a color.

However, as shown in FIG. 1(*c*), the color developing or coloring reaction of the heat sensitive recording layer 115 can be controlled due to the action of the control layer 107.

The above-mentioned ink ribbon 101 has a structure that the two layers, namely, the ink layer 105 formed of the primary color and the control layer 107 formed of the desensitizing material are respectively supported on the base film 103. However, alternatively, the ink ribbon 101 may have another structure, e.g., a single layer containing both ink and desensitizing material can be supported on the base film.

Next, a description will be provided of a first embodiment of a color recording device according to the invention.

Figure 2:
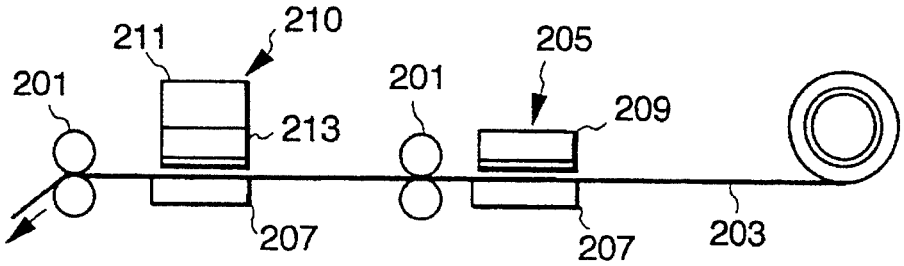
FIG. 2 is a flow sheet of a first embodiment of a color recording device according to the invention.

FIG. 2 provides a flow sheet for a color recording device according to the invention. In FIG. 2, direct heat sensitive paper 203, which can be driven and fed by feed rollers 201, is firstly pressed against and supported by a platen roller 207 and is directly printed by a thermal head 209 in a first recording part 205. Then, in a second recording part 210, the direct heat sensitive paper 203 is transferred and printed by a thermal head 213 through a required ink ribbon out of a plurality of ink ribbons to be stored in a ink ribbon cartridge 211.

Figure 3:
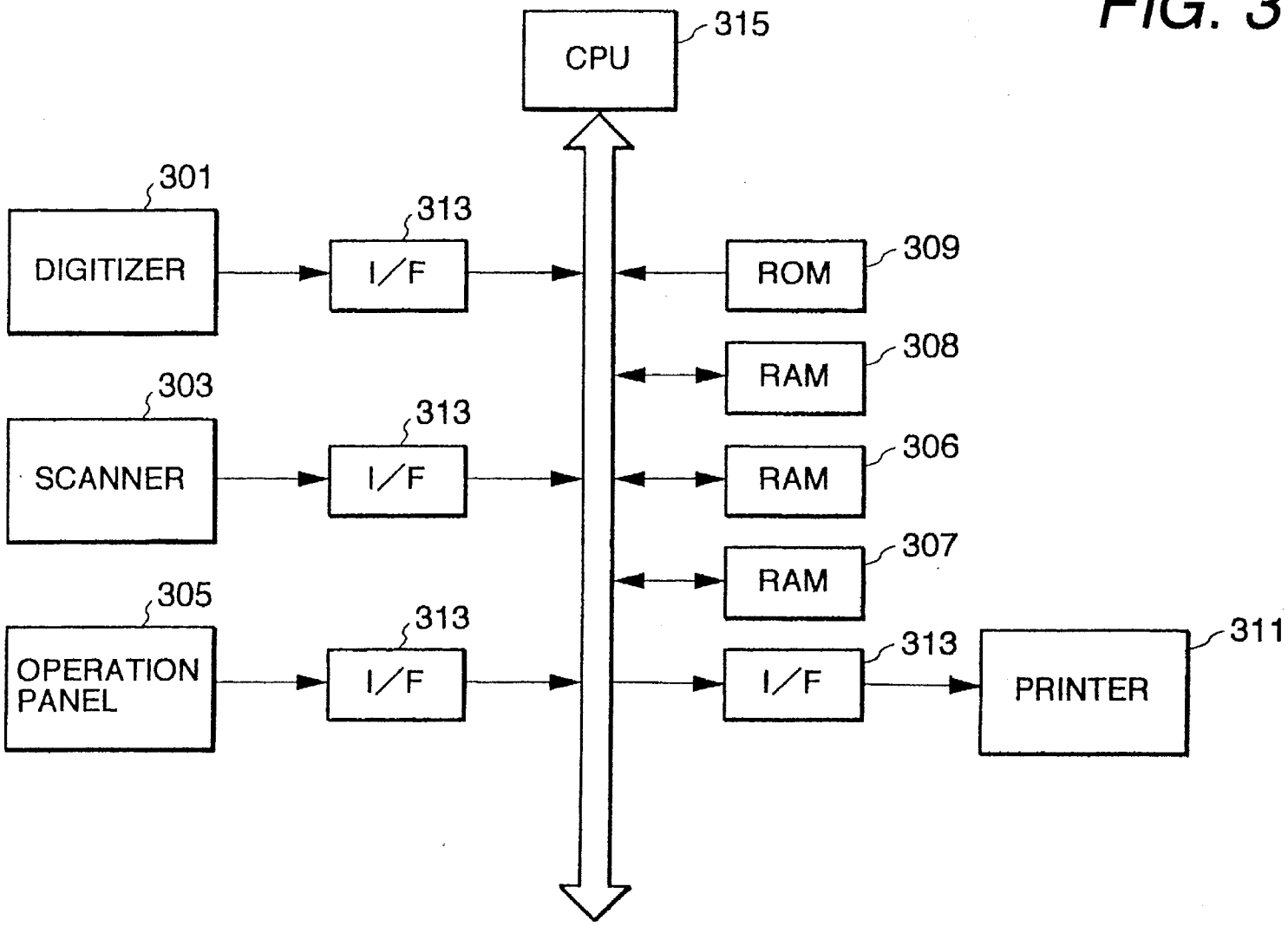
FIG. 3 is a block diagram of the color recording device shown in FIG. 2.

FIG. 3 is a block diagram of a control part of the above-mentioned color recording device. The control part comprises a digitizer 301 for instructing color conversion and conversion area with respect to the image information to be input, a scanner 303 for inputing the image information therein, an operation panel 305 for instructing the magnification conversion of the image instructed for conversion to thereby specify a print size, a random access memory (which is hereinafter referred to as RAM) 306 for storing and holding therein editing data in connection with the instructed conversion processing, a RAM 307 for storing and holding image data therein, a RAM 308 for storing and holding therein the image data including the color conversion data, a read only memory (which is hereinafter referred to as ROM) 309 for storing a system program used to execute the instructed processing, a printer 311 for outputing the processed image information, an interface 313 for connecting the associated equipment with each other, and a central processing unit 315 (which is hereinafter referred to as CPU) for controlling the timing of the whole device.

Figure 4:
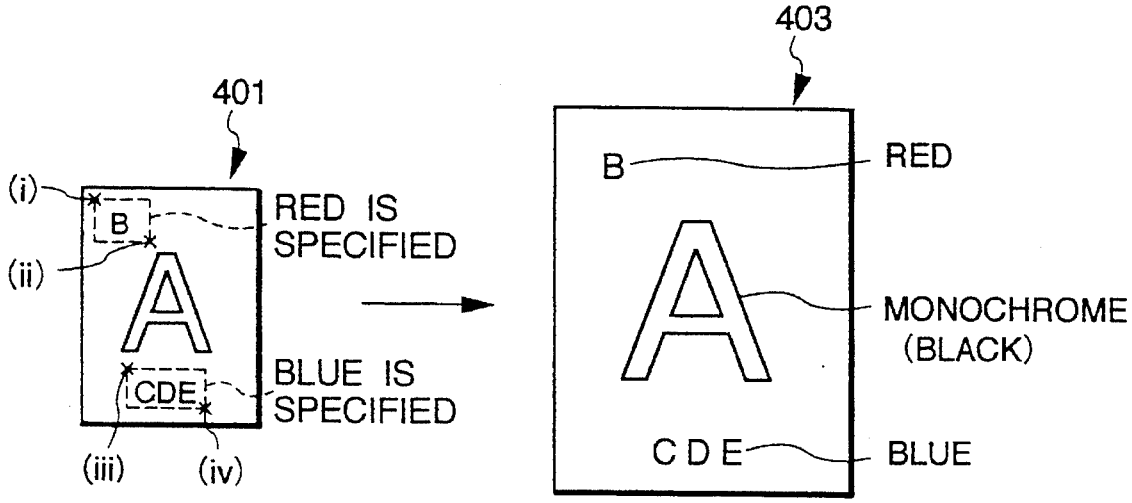
FIG. 4 is a view of a print obtained by the color recording device shown in FIGS. 2 and 3.

FIG. 4 illustrates a print produced by the above color recording device. That is, for a character existing on a black and white manuscript 401, mutually opposing points i), ii) and iii), iv) representing color conversion areas are specified, and red is specified to the area to be defined by the opposing points i), ii), while blue is specified to the area to be defined by the opposing points iii), iv). After completion of the color conversion processing, the print size is specified.

On the print 403 on which the color conversion and magnification conversion processings have both been performed, there are then formed a red character, a blue character respectively printed through the above-mentioned ink ribbons, and a black character printed directly on the direct heat sensitive paper.

Figure 5:
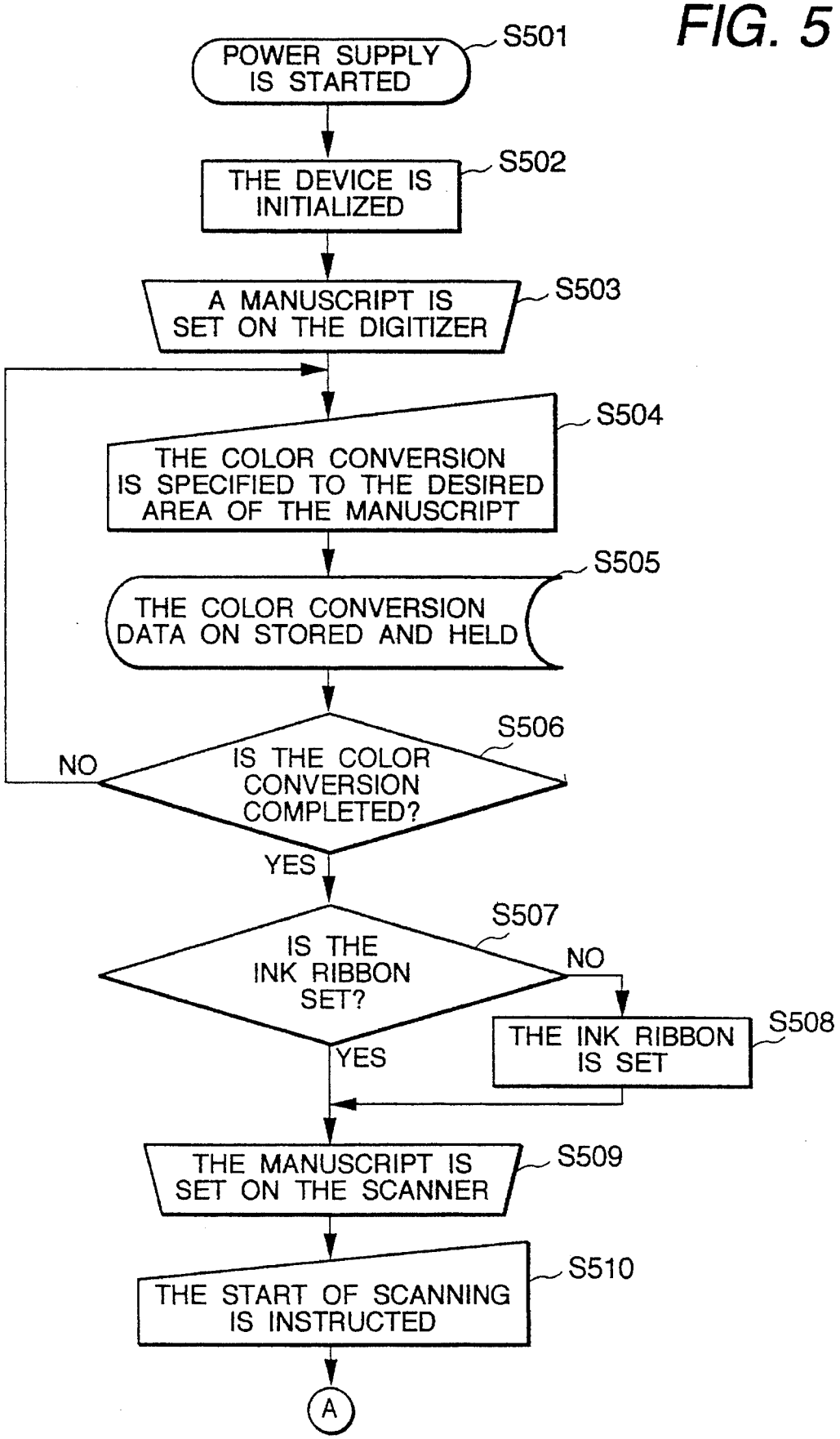
FIG. 5 is a flow chart of processing which can be performed by the device shown in FIGS. 2 and 3.

Next, the operation of the above color recording device with reference to FIGS. 5 and 6 which show the flow charts of the processings to be performed by the color recording device, will be discussed.

The power supply of the device is started (S501), and then the position of the first thermal head for checking the presence or absence of the recording paper and for executing printing directly and the position of the second thermal head for executing transfer printing are detected respectively, so that the device is initialized (S502).

Then, a manuscript is set on the digitizer (S503), and the color conversion is specified to the desired area of the manuscript (S504). The color conversion data are stored and held in the RAM 308 (S505). By performing the processings in S504 and S505 repeatedly, the color conversion specification is executed a required number of times.

After completion of the color conversion (S506 Yes), it is checked whether the necessary ink ribbon(s) for the color conversion are set in the second recording part (S507).

If the ink ribbon is not set (S507 No), then the ink ribbon is set (S508) and, then, the manuscript is set on the scanner (S509) and the start of scanning is instructed (S510).

The scanner reads the image data sequentially in a line unit (S511), and the image data are stored and held in the RAM 306 until the recording is completed in the first and second recording parts (S512). And, the image data are read out sequentially (S513) and it is checked sequentially whether the image data are the above-mentioned color conversion data or not (S514).

If it is not necessary for the readout image data to be color converted (S514 No), then the image data is immediately recorded directly in the recording paper in the first recording part (S515). If it is necessary that the readout image data be color converted by means of the color conversion data (S514 Yes), then it is detected whether an ink ribbon corresponding to the color specified by the second recording part is set at a given position (S516). If sequential recording (to be described later) is executed, then it is detected whether ink ribbons respectively corresponding to a plurality of colors are set at their given positions.

A plurality of ink ribbon cartridges are incorporated in the second recording part, and, if the corresponding ink ribbon is not set at its given position (S516 No), then the corresponding cartridge in set at its given position (S517).

Then, in the second recording part, the image data containing the color conversion data are recorded and held in the RAM 307 (S518), the CPU determines that the corresponding line has reached the second recording part and the transfer recording is started (S519). The recording in the second recording part is controlled by the CPU and is executed at the optimum timing, and thus it can be controlled independent of the recording operation in the first recording part.

Also, because a specified color may be produced by means of over-recording of a plurality of colors, it is determined whether such over-recording is necessary (S520). In addition to over-recording, when executing the sequential recording in which a plurality of colors are recorded in the same line, it is determined whether the sequential recording is necessary.

If it is determined that over-recording is necessary (S520 No), then the feeding of the recording paper is stopped (S521) and it is determined whether the ink ribbons to be over-recorded are set at the desired position (S516). Then, the over transfer recording of a plurality of desired inks is executed on the same line.

If the over-recording is not necessary (S520 Yes), then the stop of the feeding of the recording paper is removed (S522) to thereby resume feeding the recording paper.

After the reading of the image data on the manuscript is completed (S523 Yes), the processings in and after S511 are executed on all image data, and the end of the feeding of the recording paper is confirmed (S524), the print is completed (S525).

In the above-described embodiment, the description has been given of an example in which an image is recorded on the direct heat sensitive paper shown in FIG. 1. However, alternatively, the image can be recorded on a heat transfer sheet consisting of a combination of two kinds of sheets bonded to each other: that is, a heat sensitive recording sheet including a support member and a heat sensitive recording layer coated on the support member and containing therein a leuco dye and a color developer; and, a heat sensitive transfer donor sheet including a support member and a heat sensitive transfer layer coated on the support member and containing ink and desensitizing material for controlling the reaction of the leuco dye and color developer.

In this embodiment, in the first recording part, the desensitizing material and ink are transferred to the heat sensitive recording sheet, whereby only the coloring due to the ink can be developed on the heat sensitive recording sheet. Next, the heat sensitive transfer donor sheet is peeled off, heat energy is applied to the non-coloring portion of the heat sensitive recording sheet, whereby only the coloring due to the leuco dye and color developer layer can be developed on the heat sensitive recording sheet.

A second embodiment of a color recording device according to the invention with reference to FIGS. 7 to 9 will now be described.

Figure 7:
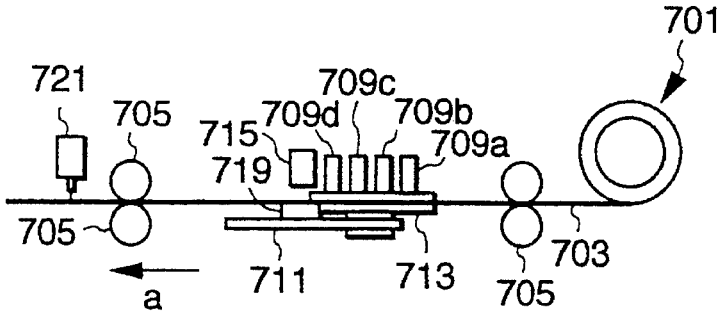
FIG. 7 is a schematic side view of a second embodiment of a color recording device according to the invention.
Figure 8:
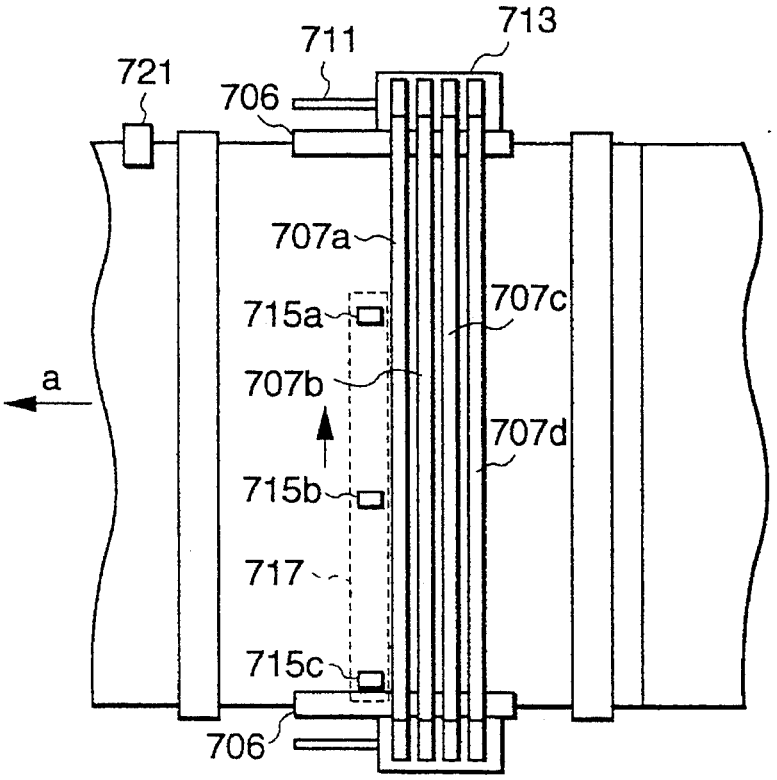
FIG. 8 is a schematic plan view of a second embodiment of a color recording device according to the invention.
Figure 9:
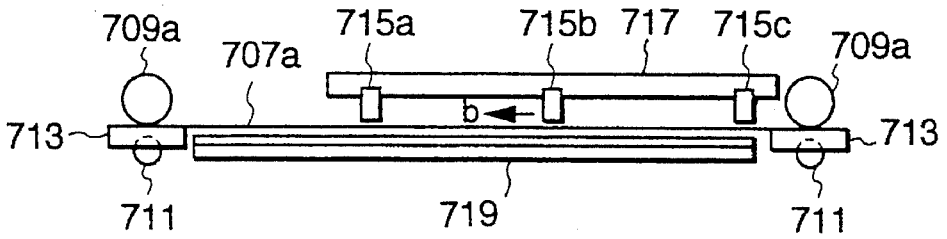
FIG. 9 is a schematic front view of a second embodiment of a recording device according to the invention.

FIGS. 7 to 9 illustrate a schematic side view, schematic plan view and schematic front view, respectively, of the color recording device.

In particular, a direct heat sensitive paper 703 wound around a roller 701 is fed and moved in a direction of an arrow a in FIG. 7 while it is driven by a feed roller 705 and is guided by a guide 706.

In a direction perpendicular to the feeding direction of the direct heat sensitive paper 703, ink ribbons 707*a*, 707*b*, 707*c* and 707*d* respectively coated with yellow, cyan, magenta and black inks are wound by cartridges 709*a*, 709*b*, 709*c*, and 709*d*, respectively.

The cartridges 709*a* to 709*d* are respectively placed on a moving guide 713 which is movable along a moving guide rail 711 extending in the paper feeding direction. Also, a plurality of thermal heads 715*a*, 715*b*, 715*c* are provided and a shuttle 717 movable in a direction of an arrow b in FIG. 9 is provided so as to extend across the thermal heads.

At the scanning positions of the thermal heads 715*a* to 715*c*, there is provided a platen rubber 719 which can be pressed against and support the direct heat sensitive paper 703. After recording, the direct heat sensitive paper 703 can be cut by a cutter 721.

Next, the recording operation according to the invention will be described.

Figure 10:
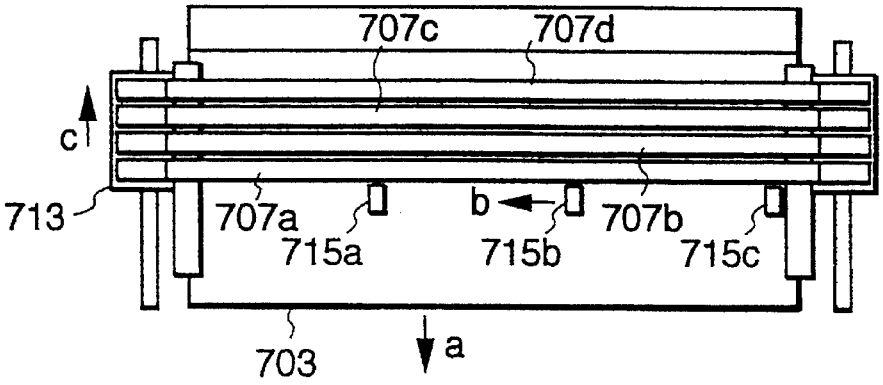
FIG. 10 is a view of the operation of the recording device shown in FIG. 7; and, FIGS. 11(*a*) and 11(*b*) are views of the operation of the recording device shown in FIG. 7.

FIG. 10 shows a recording operation to be performed when an image is recorded by supplying heat energy directly to the direct heat sensitive paper.

At first, the moving guide 713 is moved in a direction of an arrow c shown in FIG. 10 to move the ink ribbons 707*a* to 707*d* away from their recording positions. After then, the direct heat sensitive paper 703 is fed and moved in the direction of arrow a in FIG. 10 and, at the same time, the thermal heads 715*a* to 715*c* are moved in a direction of an arrow b shown in FIG. 10, thereby directly recording the image on the direct heat sensitive paper 703.

Figure 11A:
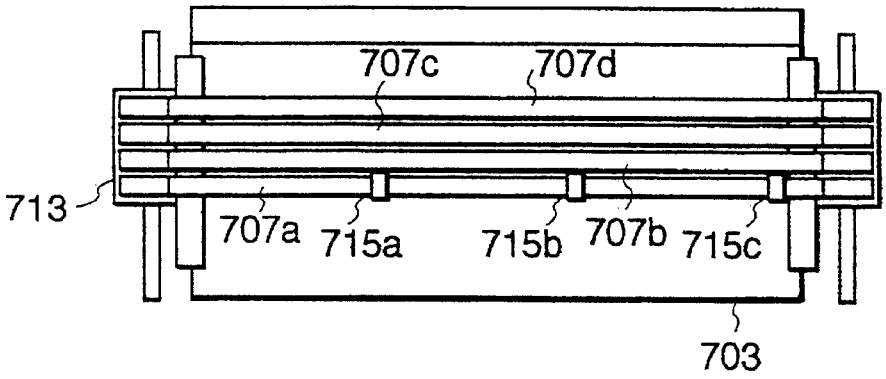
Figure 11B:
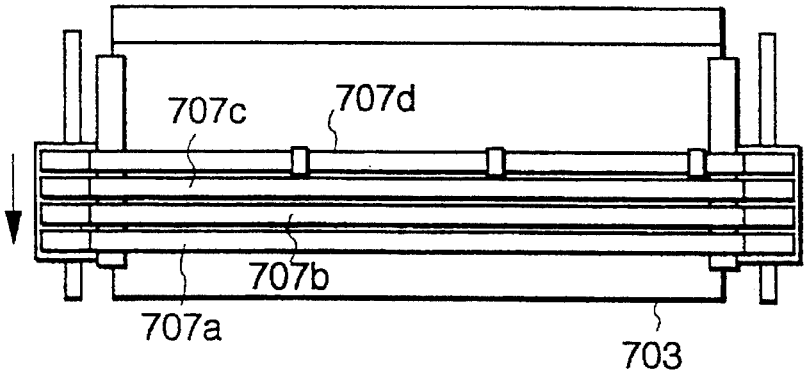

FIGS. 11(*a*) and (*b*) respectively show a recording operation to be performed when the color ink is transferred by supplying heat energy to the ink ribbon.

In particular, FIG. 11(*a*) shows a case in which yellow is transferred to the direct heat sensitive paper 703. That is, by driving the moving guide 713, the ink ribbon 707*a* coated with an yellow ink is set opposed to the thermal heads 715*a* to 715*c*. After then, the direct heat sensitive paper 703 is fed and moved but also the thermal heads 715*a* to 715*c* are moved to thereby transfer the yellow ink to the direct heat sensitive paper 703.

Also, FIG. 11(*b*) shows a case in which black is transferred to the direct heat sensitive paper 703. That is, by driving the moving guide 713, the ink ribbon 707*d* coated with a black ink is set opposed to the thermal heads 715*a* to 715*c*. After then, the direct heat sensitive paper 703 is fed and moved and the thermal heads 715*a* to 715*c* are moved to thereby transfer the black ink to the direct heat sensitive paper 703.

Further, when magenta or cyan are recorded, similar to the transfer of the yellow and black respectively shown in FIGS. 11(*a*) and (*b*), a required ink ribbon is set opposed to the thermal heads and the required ink can be transferred to the direct heat sensitive paper by movements similar to those discussed above.

The present invention allows the color ink to be transferred to a predetermined minor area of the direct heat sensitive paper to thereby record the image thereon. This makes it possible to reduce the amount of expensive ink ribbon employed. Therefore, when compared with the conventional image recording method in which a color ink is transferred by use of an ink ribbon, the invention can reduce the operating costs of the system. Also, because the color recording is capable of being provided on a predetermined minor area and the color recording can be readily achieved by heat transfer, a color recording can be produced simply and easily.

Although the present invention has been described in terms of certain embodiments, such are merely illustrative in nature and in no way limit the claimed invention. Certain modifications, omissions, and substitutions can be made without departing from the spirit thereof. Accordingly, the scope of the present invention should only be determined by the scope of the following claims, including equivalents thereof.

What is claimed is:

1. A color recording method for providing multiple colors on a direct heat sensitive paper comprises:

(a) providing a direct heat sensitive paper comprising a base coated with at least one leuco dye and at least one color developer;

(b) developing a first color on a predetermined first portion of the heat sensitive paper through a color developing reaction between the leuco dye and the color developer;

(c) developing a second color on a predetermined second portion of the heat sensitive pater by transferring an ink and a desensitizing material onto the second predetermined portion of the direct heat sensitive layer, said desensitizing material being present in an amount effective to prevent any substantial color developing reaction at said second portion of said heat sensitive paper.

2. The color recording method according to claim 1 wherein further comprising repeating step (c) with another ink.

3. The color recording method according to claim 1 wherein the step (b) comprises supplying thermal energy directly to said heat sensitive paper.

4. The color recording method according to claim 1 wherein step (c) comprises:

(i) providing a ink ribbon containing at least one ink and the desensitizing material; and (ii) supplying thermal energy to said ink ribbon so as to transfer the desensitizing material and the ink to the heat sensitive paper.

5. The color recording method according to claim 4 wherein a plurality of ink ribbons are employed.

6. The color recording method according to claim 1 wherein step (c) is preformed before step (b).

7. The color recording method according to claim 1 wherein the first portion is a major portion of the paper and the second portion is a minor portion of the paper.

* * * * *